United States Patent [19]

Dearing

[11] Patent Number: 4,576,349

[45] Date of Patent: Mar. 18, 1986

[54] AIR DUCT REGISTER MOUNTING CLIP

[76] Inventor: James C. Dearing, P.O. Box 178, Talbott, Tenn. 37877

[21] Appl. No.: 478,632

[22] Filed: Mar. 24, 1983

[51] Int. Cl.[4] ..... G12B 9/00

[52] U.S. Cl. ..... 248/27.1; 248/DIG. 6; 248/300; 411/523

[58] Field of Search ..... 411/174, 523; 248/27.1, 248/DIG. 6, 300

[56] References Cited

U.S. PATENT DOCUMENTS

| | | | |
|---|---|---|---|
| 2,382,942 | 8/1945 | Murphy | 411/174 |
| 2,692,697 | 10/1954 | Hamilton | 248/DIG. 6 |
| 2,771,501 | 11/1956 | Despard | 248/DIG. 6 |
| 3,376,612 | 4/1968 | Munse | 411/523 |
| 4,243,086 | 1/1981 | Kuttler et al. | 411/523 X |
| 4,431,151 | 2/1984 | Schonasky | 248/27.1 |
| 4,440,535 | 4/1984 | Oehlke | 411/174 X |

*Primary Examiner*—J. Franklin Foss
*Assistant Examiner*—David L. Talbott
*Attorney, Agent, or Firm*—Burns, Doane, Swecker & Mathis

[57] ABSTRACT

A mounting clip is disclosed which is formed of a pliable metal and is adapted to be bent around an opening in a wall to allow an air duct register to be mounted in place. The clip includes a circular hole which is positioned at the front surface of the wall and a narrow elongated slot at the back surface of the wall. A threaded fastener passes through mounting holes in the air duct register, the circular holes in the mounting clip and the wall, and engages the edges of the narrow slot. The edges of the narrow slot deform to form burrs which engage the wall to firmly hold the clip in place. By providing the clip with an elongated slot, the clip is adjustable and may be used with walls of various thicknesses.

2 Claims, 3 Drawing Figures

AIR DUCT REGISTER MOUNTING CLIP

SUMMARY OF THE INVENTION

According to the invention, a mounting clip is provided which is made of gauge sheet metal which will provide a means of attaching registers, with narrow edge distances, to air ducts installed in wall openings. It is preferred that the clip be made of metal with a thickness and stiffness that will facilitate bending to size and shape by hand.

The clip is made by stamping and/or shearing coiled sheet metal into a rectangular shape with a circular hole near one end, the center point of which is located on the longitudinal center line of the clip. A narrow slot begins at a point near the circular hole and follows the longitudinal center line to a point adjacent to the opposite end. Finish coating of the clip may be either galvanized, painted, plain, or any mill finish suitable for a particular end use.

The clip is supplied flat and bent by hand to fit around the edge of a wall opening with the circular hole in front and the slot behind. A sheet metal screw is inserted in the mounting holes of the register and air duct, passing through the mounting clip hole and wall material, with the threads engaging the mounting clip slot. As the screw is tightened, the threads deform the slot edges forming burrs, thus holding the clip in place in event the screw is later removed.

Design of the clip permits its use on a variety of wall thicknesses and edge distances. By increasing the front tab length, the screw can be set further from the wall opening edge. The slot in the back tab provides a point anywhere along its entire length for the screw threads to catch, thus eliminating the need for self-tapping screws or pilot holes.

Wall material such as gypsum board (sheetrock), thin panelling or plaster will not support screw threads without breaking apart or splintering. An oversized hole drilled through the wall material allows the screw to pass through without biting in, keeping the material intact. The clip also permits removing and retightening the screw several times without stripping out because the slot edges are bent to conform to the contour and pitch of the threads.

Other uses of the mounting clip include, but not limited to, installation of electrical switch boxes and low voltage apparatuses.

BRIEF DESCRIPTION OF THE DRAWINGS

This invention can be more easily understood from a study of the drawings in which.

DESCRIPTION OF THE PREFERRED EMBODIMENT

Figure 1:
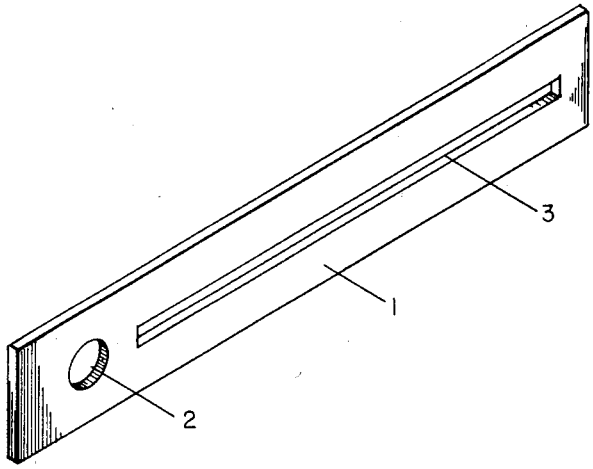
FIG. 1 is an isometric view of the mounting clip showing the configeration and relative size of the various parts before being bent into shape for use.

Referring to FIG. 1, the mounting clip comprises a thin, rectangular, pliable metal sheet 1 having a circular hole 2 and a narrow, elongated slot 3 formed therein. The center point of the circular hole 2 is located on the longitudinal center line of the metal sheet 1, and the elongated slot 3 is concentric with the longitudinal center line of the metal sheet 1.

The metal sheet 1 must be sufficiently pliable to allow it to be bent by hand, but must withstand bending without cracking or fatiguing. It must also have a tensile strength sufficient to hold screw threads without tearing or stripping. Metals which meet these requirements include low carbon cold rolled sheet steel, aluminized steel, 110 non-heat treatable aluminum, type 304L stainless steel and type 316 stainless steel. Preferably, the sheet metal has a tensile strength not less than 14,000 P.S.I. and a temper not harder than Rockwell B75.

Sheet or coil stock is stamped or sheared to size and shape by a punch and die mechanism. The metal sheet 1 would typically be approximately 3 inches long and ½ inch wide, the circular hole 2 would be approximately 3/16 of an inch in diameter and spaced ⅜ of an inch from the end of the sheet 1. The slot 3 would extend from a point approximately ¼ of an inch from the center of the circular hole 2 along the longitudinal center line of the sheet 1 for a distance of approximately 2¼ inches toward the opposite end. Preferably the thickness of the metal sheet 1 is no greater than 0.036 of an inch.

Figure 2:
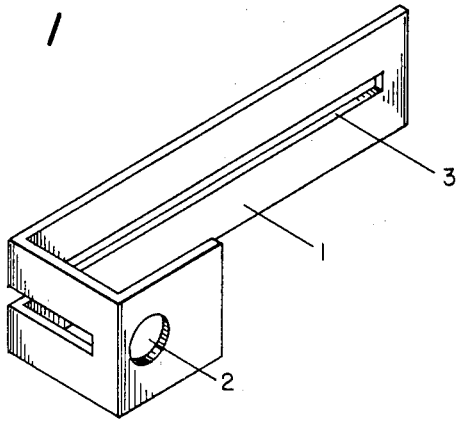
FIG. 2 is an isometric view of the mounting clip illustrating the shape after it is bent for use.
Figure 3:
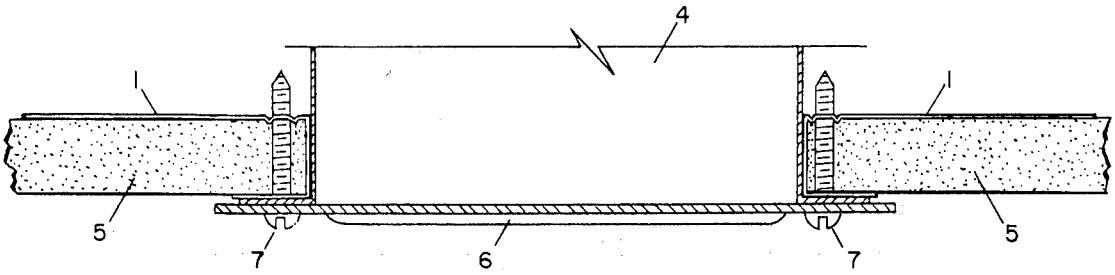
FIG. 3 is a sectional view of the mounting clip in use.

As shown in FIGS. 2 and 3, in use the clip is bent into a generally U-shaped configuration so that the portion of the sheet 1 wherein the circular hole 1 is provided forms a mounting tab. The sheet 1 is bent once in a transverse direction relative to the longitudinal center line of the clip so that it extends into the opening in the wall 5 for a distance corresponding to the thickness of the wall 5. The sheet is bent a second time in the transverse direction so that the clip extends along the back surface of the wall 5, directly behind the mounting tab.

After the clip is bent into position on the wall 5, the walls of the duct 4, which initially extended for a short distance beyond the opening in the wall 5, are folded outwardly to a position adjacent the mounting tab of the sheet 1. The walls of the duct 4 are provided with mounting holes which align with the circular hole 2 of the mounting clip.

An air duct register 6 is then placed over the folded portion of the air duct 4. The register 6 is provided with mounting holes which are aligned with the mounting holes of the duct 4 and with the circular hole 2 of the mounting clip. A threaded fastener 7 passes through the mounting holes of the register 6 and air duct 4, and circular hole 2 of the mounting clip, the wall 5 and the narrow slot 3 on the back surface of the wall 5. The threads of the threaded fastener 7 engage the edges of the narrow slot 3 to hold the threaded fastener in place. Thus, the register 6 is firmly held in place. As the threaded fastener 7 is screwed in place, the edges of the slot 2 are deformed to form burrs which engage the wall 5 (FIG. 3). These burrs hold the mounting clip in place in the event that the threaded fastener 7 is removed.

In some cases it is undesirable to have the threaded fastener engage the wall 5 since some wall materials such as gypsum board, thin panelling or plaster will not support the screw threads without breaking apart or splintering. In these cases, an oversized hole is drilled through the wall material to allow the threaded fastener 7 to pass through the wall without biting into the wall material.

The mounting clip has the advantage of being easily installed and adjustable to allow it to be used with walls of various thicknesses. The position of the threaded fastener 7 relative to the wall opening can be varied simply by increasing the length of the mounting tab.

What is claimed:

1. A one-piece, self-contained mounting clip for attaching an air duct register to an air duct installed in an opening in a wall having a front surface and a back surface, wherein said air duct extends through said wall opening beyond said front wall surface, comprising a thin rectangular sheet of pliable metal having at one end a first portion with a circular hole arranged therein, said circular hole having a center point located on the longitudinal center line of said sheet; and a second portion with a narrow, elongated slot having the same longitudinal center line as said sheet and extending from a first point adjacent said circular hole to a second point adjacent an end of said sheet opposite said one end, the width of the narrow slot being less than the diameter of said circular hole; said clip bendable in a transverse direction relative to the longitudinal centerline of said clip such that said first portion forms a mounting tab on the first surface of said wall and said second portion extends into the wall opening for a distance corresponding to the thickness of the wall at said opening and across the back wall surface directly behind said mounting tab to thereby substantially conform to the wall opening, so that the portion of the air duct extending beyond said wall opening may be bent over said mounting tab and a threaded fastener installed through aligned mounting holes in said register and said air duct, and through said circular hole and said elongated slot, said slot defining an infinite range of positions along the length of the slot which engage said threaded fastener, the edges of said elongated slot deformed upon installation of said threaded fastener to form burrs which hold the clip in place when the threaded fastener is removed.

2. A method for attaching air duct registers to air ducts installed in an opening in a wall having a front surface and a back surface, wherein a portion of said air duct extends through said wall opening beyond said front wall surface, said method utilizing a thin, rectangular mounting clip provided at one end with a circular hole, the center of the circular hole located on a longitudinal centerline of said clip, and with a narrow, elongated slot along the longitudinal centerline of said clip extending from a point adjacent an end of said clip opposite said one end to a point adjacent said circular hole, wherein said slot is provided with a width less than the diameter of said circular hole, comprising the steps of:

(a) bending said mounting clip around said wall opening, the portion of said clip provided with the circular hole forming a mounting tab, extending a portion of the clip into said wall opening a distance corresponding to the thickness of said wall and across the back surface of said wall behind said mounting tab such that said mounting clip substantially conforms to the wall opening, said elongated slot arranged on the portion of the clip extending across the back surface of the wall;

(b) folding the extended portion of said air duct over said mounting tab such that a mounting hole in said air duct is aligned with said circular hole of said mounting clip;

(c) placing said air duct register over said folded air duct portion such that a mounting hole in said register is aligned with said air duct mounting hole and said circular hole in said mounting clip; and (d) threading a threaded fastener through said register mounting hole, said air duct mounting hole, said circular hole in said mounting clip, said wall, and said narrow slot, thereby to attach said air duct register to said air duct and said wall, and to deform the edges of said narrow slot to form burrs which engage said wall to hold the mounting clip in place when said threaded fastener is removed.

* * * * *